US008663040B2

(12) United States Patent
Kortegast

(10) Patent No.: US 8,663,040 B2
(45) Date of Patent: Mar. 4, 2014

(54) ILLUMINATED GAME BALL AND KIT

(76) Inventor: Bede Kortegast, Seattle, WA (US)

( * ) Notice: Subject to any disclaimer, the term of this patent is extended or adjusted under 35 U.S.C. 154(b) by 22 days.

(21) Appl. No.: 13/546,396

(22) Filed: Jul. 11, 2012

(65) Prior Publication Data

US 2013/0029794 A1 Jan. 31, 2013

Related U.S. Application Data

(60) Provisional application No. 61/513,404, filed on Jul. 29, 2011.

(51) Int. Cl.
*A63B 43/00* (2006.01)

(52) U.S. Cl.
USPC ..... 473/570

(58) Field of Classification Search
USPC ..... 473/570, 571, 594, 595, 600
See application file for complete search history.

(56) References Cited

U.S. PATENT DOCUMENTS

| | | | | |
|---|---|---|---|---|
| 4,595,200 | A * | 6/1986 | Shishido | 473/570 |
| 5,236,383 | A * | 8/1993 | Connelly | 473/570 |
| 5,375,839 | A * | 12/1994 | Pagani | 473/570 |
| 5,609,411 | A * | 3/1997 | Wang | 473/570 |
| 5,954,603 | A * | 9/1999 | Chursinoff | 473/594 |
| 6,117,030 | A * | 9/2000 | Green, Sr. | 473/570 |
| 6,575,855 | B1 * | 6/2003 | Buzak et al. | 473/569 |
| 6,712,721 | B2 * | 3/2004 | Buzak et al. | 473/498 |
| 6,723,013 | B2 * | 4/2004 | Ilcisin et al. | 473/570 |
| 7,014,581 | B2 * | 3/2006 | Ng | 473/570 |
| 8,517,870 | B2 * | 8/2013 | Crowley et al. | 473/570 |
| 2007/0021244 | A1 * | 1/2007 | Ko | 473/570 |
| 2007/0281811 | A1 * | 12/2007 | Wang | 473/570 |
| 2008/0132363 | A1 * | 6/2008 | Harada | 473/570 |
| 2009/0062033 | A1 * | 3/2009 | Harada | 473/353 |
| 2012/0244969 | A1 * | 9/2012 | Binder | 473/570 |
| 2013/0023365 | A1 * | 1/2013 | Idoni-Matthews et al. | 473/570 |

* cited by examiner

*Primary Examiner* — Steven Wong
(74) *Attorney, Agent, or Firm* — Dean A. Craine

(57) ABSTRACT

An improved LED illuminated game ball designed to be used in Bocce or Petanque. The game ball includes a solid, opaque spherical body with a threadingly connected illuminated cap assembly that is axially aligned and partially extends into the spherical body. The illuminated cap assembly includes an outer housing, and intermediate member, and a lower inner housing. Mounted on the intermediate member is a PCB with a multi-functional switch and a longitudinally aligned plunger switch. The intermediate member also includes a downward extend bridle with a downward extending LED bulb. Located inside the bridle is a plurality of stacked watch batteries. The outer housing includes top plate with a transversely aligned slot and a plunger bore through which the plunger switch and the closed neck on a sealing washer disposed under the top plate partially extends after assembly. The end of the plunger switch is recessed and enclosed in a watertight seal.

7 Claims, 6 Drawing Sheets

ILLUMINATED GAME BALL AND KIT

This utility patent application is based on and claims the filing date benefit of U.S. provisional patent application, Application No. 61/513,404, filed on Jul. 29, 2011.

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to game equipment and more particularly, to game equipment that includes a ball that is rolled across the ground to a particular target or location and makes contacts with other balls or objects.

2. Description of the Related Art

Bocce ball is a popular game in which opposing players or teams attempt to roll a ball assigned to them to a position closer to a smaller target ball than the ball tossed by an opposing player. The game is made up of rounds in which players toss or roll their balls at the smaller target ball typically located 30 to 70 feet away. In each round, the player who tosses the closest ball or balls to the target ball is awarded one or more points. The rounds are repeated until a player or team is awarded the designated points needed to win the game, typically 10 or 15 points.

Prior to playing, each player or team is assigned two to four balls. Those balls have a unique, identifiable color/s that is visible from the opposite end of the court or playing area. The balls and usually made of plastic and typically measure 4.25 inches in diameter and weighs approximate 3 lbs.

Recently, illuminated Bocce balls have been developed that enable the game to be played at night or in dark environments. For example, U.S. Pat. Nos. 6,575,855, 6,712,721 and 6,723,013 each disclose a day and night croquet and Bocce ball that uses a chemoluminscent stick inserted into a bore that partially extends into the ball. Unfortunately, the chemoluminescent stick remains active for a relatively short time and must be replaced after a few minutes. Needless to say, keeping on hand a large quantity of new chemoluminescent sticks is not only burdensome and expensive but also distracts the players and reduces the overall enjoyment of the game.

Ideally, what is needed is Bocce ball that includes a bright illumination source that can last several hours and when expired, can be easily and quickly replaced. To address this need, the inventor developed a Bocce ball that contains a low power LED illuminated source that includes a removable internal switch mechanism that controls activation and deactivation of the LED bulb. In an earlier version of the LED illuminated bocce ball, a plurality of batteries and a switch mechanism were mounted inside a threaded plug that was inserted into a closed threaded bore formed into the side of the ball's spherical body. Mounted on the threaded plug was a longitudinally aligned, single LED bulb. The switch mechanism was mounted on the base of the threaded plug and configured so that that the LED bulb is automatically activated when the plug is sufficiently extended into the bore so that it bottoms out on a flat face located at the end of bore. To deactive the LED bulb, the treaded cap was partially unscrewed so that the switch broke contact with the flat face. Unfortunately, this left the plug partially protruding from the ball and prevent it from rolling smoothly across a flat surface.

To solve this problem, players had to remove the batteries from the ball and reinstall the batteries when desired.

To readdress this problem, the inventor modified the switch mechanism used on the earlier version and replaced it with a partially exposed external switch located on an outer flange formed on the plug. This modification allowed the light to be manually turned ON or OFF thus allowing the ball to be used during the day or night. Unfortunately, because the external switch was partially exposed, it could be accidentally bumped ON or OFF when tossed or when rolling over rough surfaces. As a result, players were frequently required to reset the switch during play.

In the second version of the inventor's LED illuminated Bocce ball, three flat watch batteries (1.5 volts, DC) were stacked within the cap and used to power the LED. The three batteries were held in place by a bracket and a screw that held the batteries in a stacked position. Unfortunately, when the batteries needed to be replaced, a screw driver was required that was not always available. Also, because battery replacement issue arose typically at night or under poor visual conditions, removing and re-inserting the screw in the dark was problematic.

Also, on both those prior versions it was not possible to create a watertight seal between the plug in the ball body. The game is often played at the beach or on grass in damp conditions so moisture egress was a problem.

SUMMARY OF THE INVENTION

The above listed problems are addressed and solved by the improved LED game ball disclosed herein that includes a plastic, opaque spherical body in which a relatively short, lightweight, LED cap assembly is axially aligned and partially extended. Mounted on the LED cap assembly is a downward extending, longitudinally aligned LED bulb. The spherical body is sufficiently opaque so that when the LED is activated, the entire spherical body is uniformly illuminated and simulates a glowing ball or sphere.

The LED cap assembly includes an outer housing, an intermediately LED light assembly, and a protective, lower inner housing that fits around the intermediate LED light assembly and into the outer housing to hold the intermediate assembly in a temporary fixed location inside the outer housing.

The cap assembly's outer housing is T-shaped and includes a top flange plate with perpendicularly aligned cylinder. The top flange plate includes an outer curved surface that matches the curvature of the adjacent curve surfaces on the spherical ball surrounding a cap bore in which the illuminated cap assembly is inserted. Located under the flange plate is an optional silicone or rubber sealing washer that presses against a support surface formed in the cap bore discussed further below. The sealing washer includes an upward extending neck that extends into the plunger switch bore formed on the outer housing that prevents water and moisture from entering the outer housing. The outer housing includes a cylindrical lower body that includes a receiving space. Formed on the lower body are external threads.

The intermediate member fits into the receiving cavity formed on the lower body. The intermediate member includes a printed circuit board (hereinafter known as a PCB) with a multi-function push button type plunger switch mounted thereon. Extending downward from the PCB is a U-shaped bridle designed to hold a stack of three watch batteries and a longitudinally aligned LED bulb.

The inner housing is located below the intermediate member and includes cylindrical side walls that extend upward from a lower flat circular plate. Formed and coaxially aligned on the circular plate is a bulb bore through which the distal end of the LED bulb extends. The intermediate member is coaxially aligned over the inner housing so that the LED bulb extends through the bulb bore and the lower horizontal leg on the bridle rests against the inside surface of the inner housing's lower circular plate.

During assembly, the inner housing and the LED light assembly are longitudinally aligned and inserted into the receiving cavity formed in the outer housing. Formed on the upper edge of the side wall on the inner housing is a laterally extending tab that engages an L-shaped slot formed on the cylindrical side wall on the outer housing. When the outer and inner housings are longitudinally aligned and coaxially rotated, the tab is longitudinally aligned over the slot thereby enabling the inner housing when pushed inward and rotated, to be selectively locked the inner housing in a fixed position on the outer housing.

Also, formed on top flange plate on the outer housing is a transversely aligned slot that enables the user to easily rotate the LED cap assembly to easily attach and detach it from the cap bore. Also, formed and coaxially aligned on the top flange plate is a switch bore. The length of the outer housing's cylindrical side wall, the length of the bridle, the thickness of the PCB and the length of the plunger are sufficient so that the top surface of the plunger is transversely aligned under and slightly recessed in the switch bore thereby protecting it from contact against the surface or external objects when tossing or rolling across a playing surface.

The PCB includes a three way switch circuit that turns the LED bulb OFF, ON-SOLID, or ON-FLASHING. During use, the user is able to easily press the tip of his or her finger into the switch bore to contact the plunger and manually select the desire switch mode. When the batteries are discharged, the entire cap assembly is removed from the cap bore. The inner housing and intermediate light member are then removed from the outer housing. The three stacked batteries are manually removed and replaced without tools. New replacement batteries are then inserted into the bridle and the inner housing and intermediate member are reassembled into the outer housing. The LED cap assembly cap is then re-attached to the cap bore.

DESCRIPTION OF THE PREFERRED EMBODIMENT(S)

Figure 1:
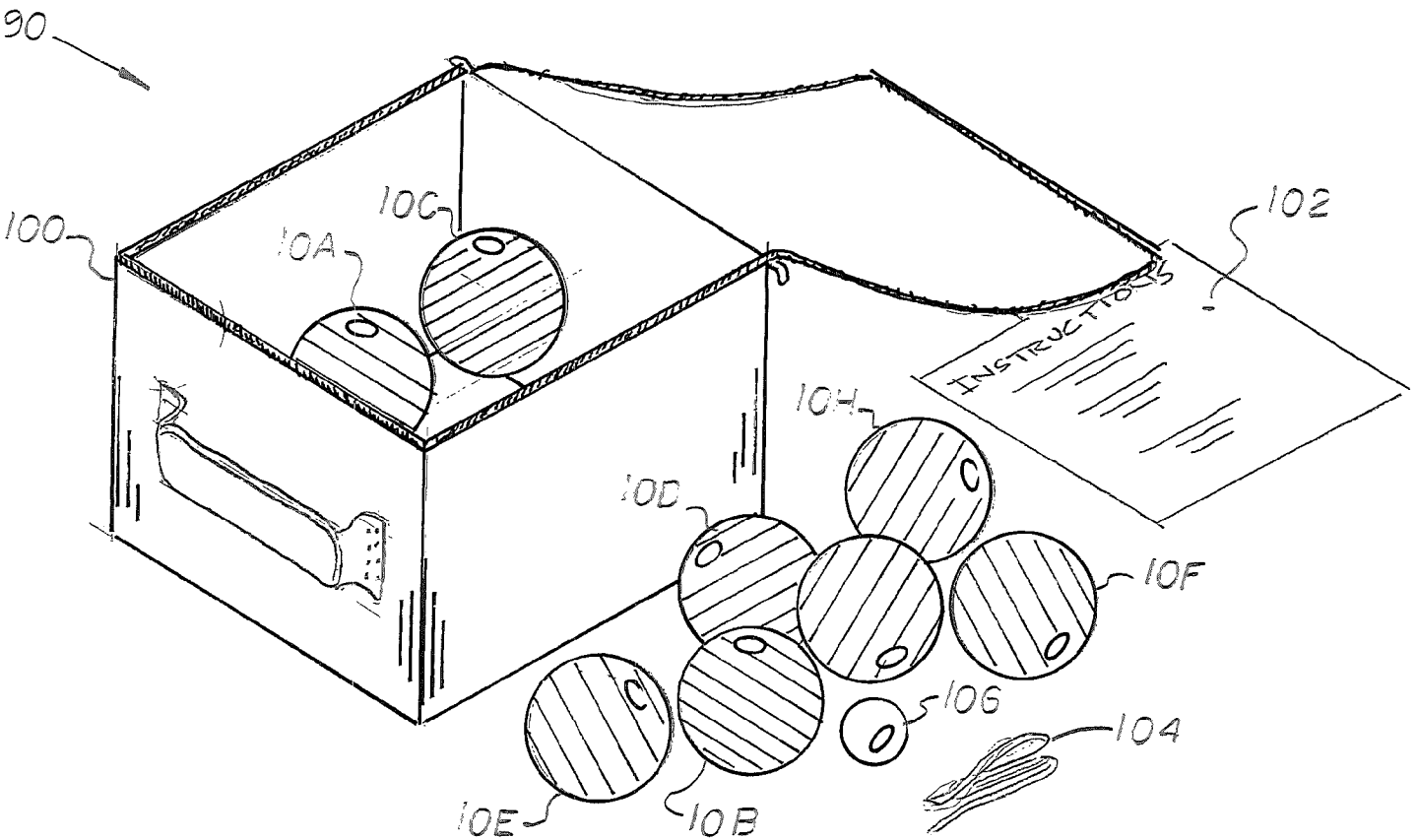
FIG. 1 is a perspective view of a perspective view of a Bocce ball kit that includes a container, four pairs of Bocce game balls, one small target ball, an instruction sheet and a tape measure.
Figure 2:
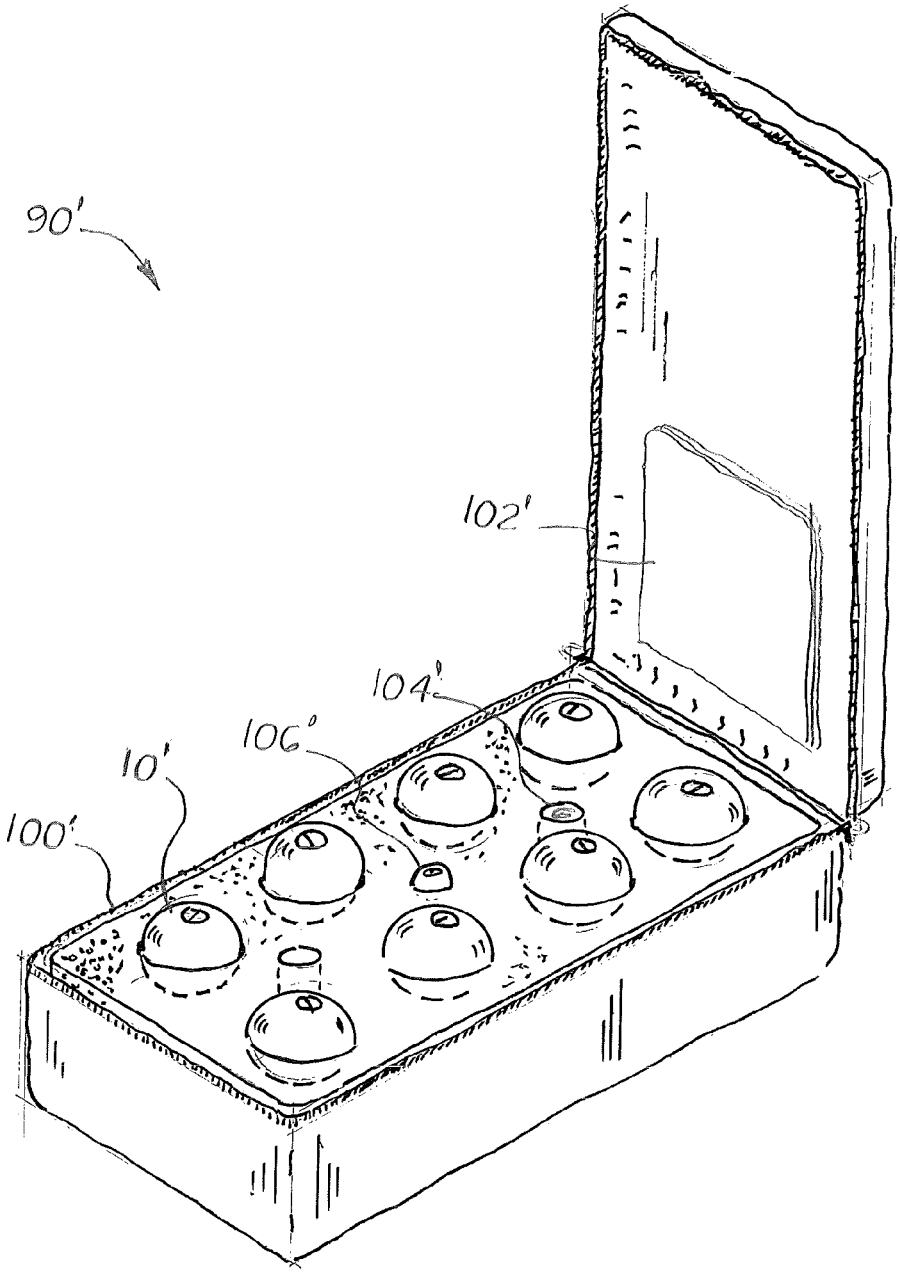
FIG. 2 is a perspective view of a perspective view of a Petanque ball kit that includes a container, four pairs of illuminated petanque game balls, one small target ball, an instruction sheet and a tape measure.
Figure 3:
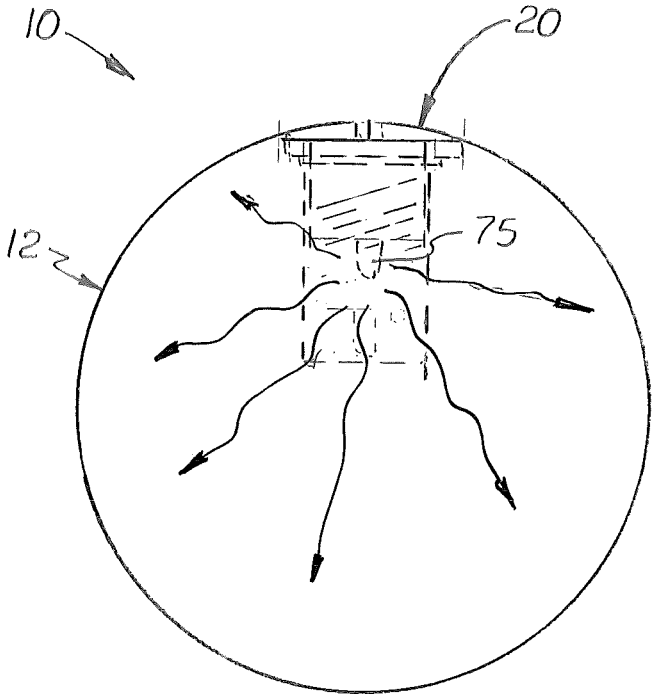
FIG. 3 is a sectional side elevational view of an improved LED illuminated game ball.
Figure 4:
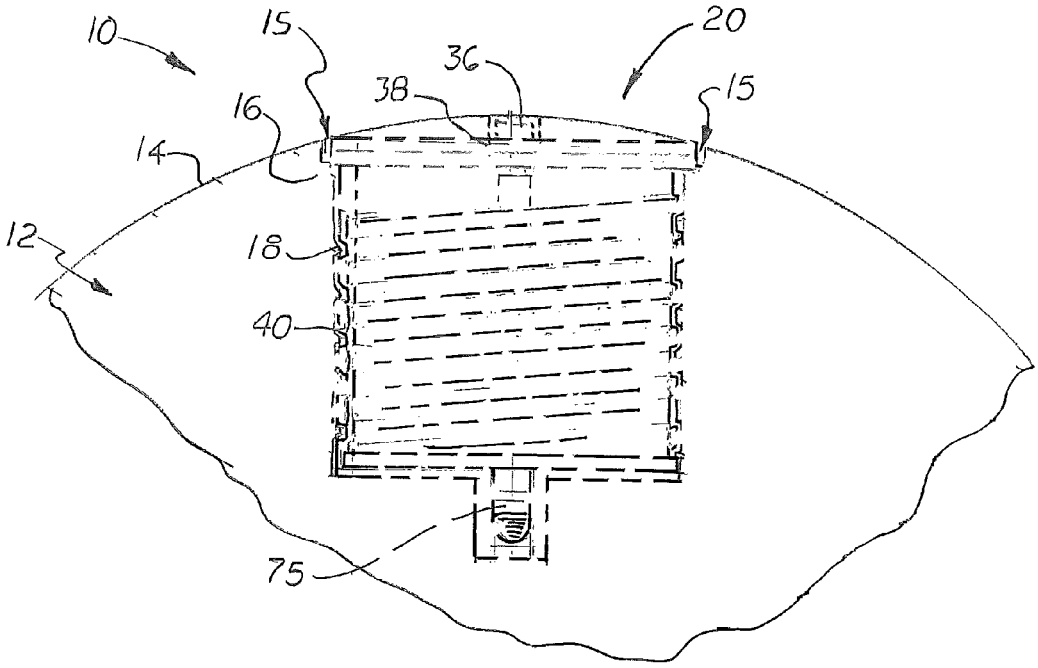
FIG. 4 is a side elevational of the game ball shown in FIG. 3.

Referring to the accompanying FIGS. 1-9, there is shown an improved LED game ball used to play Bocce or Petanque. The game ball 10 that includes a LED bulb 75 connected to a durable cap assembly 20 that selectively fits into a cap bore 15 formed on the ball's opaque spherical body 12. A watertight seal is created between spherical body 12 and the cap assembly 20 to protect the LED bulb, a PCB, a switch and a plurality of batteries. The batteries and bulb 75 are all mounted on the cap assembly 20 thereby enabling easy replacement. Also, a recessed plunger 55 is mounted on the top surface of the cap assembly that 20 that is readily accessible during play and protected from accidental activation or deactivation.

The French game Bocce and the Italian game Petanque are similar games that involve tossing balls on a court. Bocce uses balls that are approximately the size of a grapefruit and Petanque uses balls that are approximately the size of a small orange. The illuminated game ball 10 disclosed herein may be made in different sizes and used to play Bocce or Petanque.

The game ball 10 includes a spherical body 12 made of relatively hard, solid opaque plastic with an axially aligned, inward extended cap bore 15 in which a relatively short, lightweight, cap assembly 20 is inserted. The spherical body 12 has with a round outer surface 14 that enables the ball 10 to roll over a playing surface. The cap bore 15 includes an upper sitting surface 16 and internal threads 18. In the embodiment shown herein, the spherical body 12 is made of plastic and measures approximately 3 inches in diameter.

Figure 5:
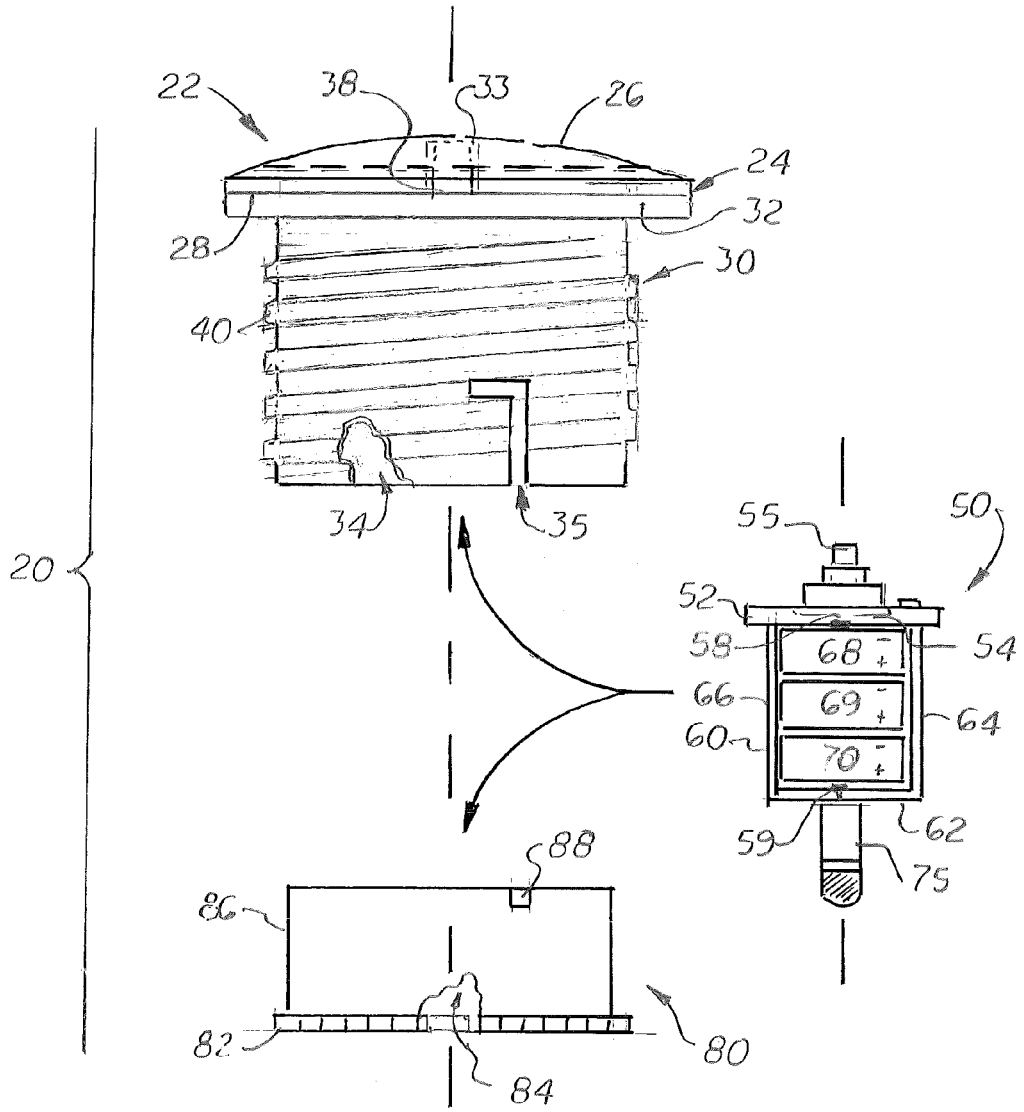
FIG. 5 is an exploded side elevational view of the illuminated cap assembly.
Figure 6:
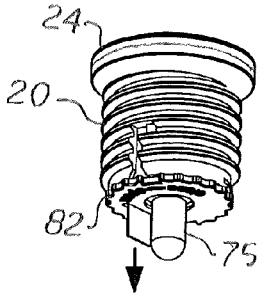
FIGS. 6-9 are sequential illustrations showing how batteries replaced in the cap assembly.
Figure 7:
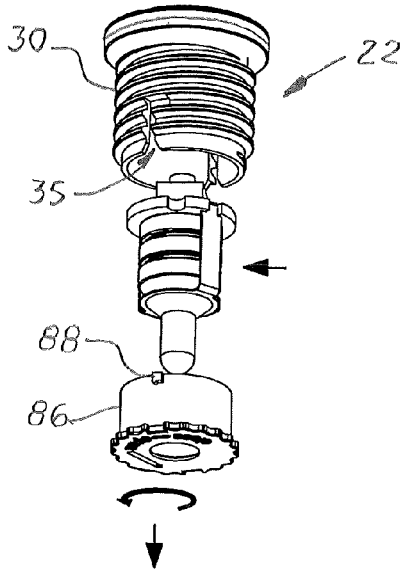
Figure 8:
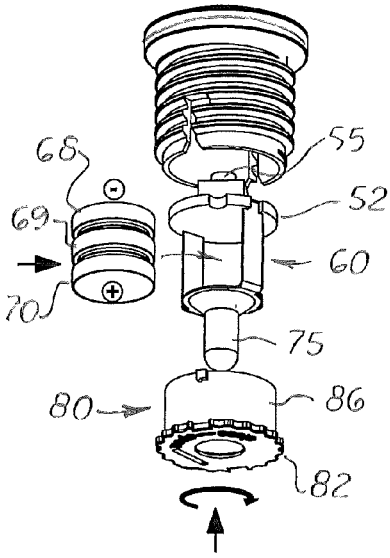
Figure 9:
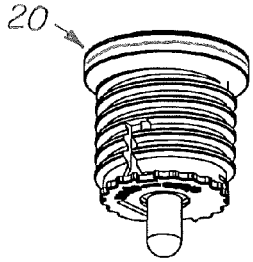

As shown in FIG. 5, the cap assembly 20 includes an outer housing 22, an intermediate member 50, and a protective, lower inner housing 80. As stated below, the intermediate member 50 fits inside the outer housing 22, and the lower inner housing 80 holds the intermediate assembly 50 in place on the outer housing 22.

The cap assembly 20 is designed to selectively attach to the cap bore 15. The cap assembly 20 includes a T-shaped outer housing 22 with a top flange plate 24 integrally formed or attached to a downward extending, perpendicularly aligned, hollow cylinder 30 opened at its lower end. The top flange plate 24 includes an outer curved surface 26 that matches the curvature of the adjacent round outer surface 16 on the spherical ball 12 surrounding cap bore 15. The flange plate 24 also includes an inner flat surface 28 designed to press uniformly against the upper sitting surface 16 in the cap bore 15 when the cap assembly 20 is tightly attached to the cap bore 15. Disposed around the cylinder 30 is an optional rubber or silicone sealing washer 32 designed to press against the upper sitting surface 16 formed on the spherical body 12 to create a water tight seal between the cap assembly 20 and the cap bore 15.

Formed on the outer curved surface 26 is a fully extending, transversely aligned slot 36 (shown more clearly in FIG. 4) designed to receive the tip using a finger or finger nail or the edge of a coin. Coaxially aligned with the top flange plate 24 and centrally formed on the slot 36 is a short, axially aligned plunger bore 38. The sealing washer 32 includes a coaxially aligned, upper extending closed neck 33 that fits into to plunger bore 38. During assembly, the plunger 55 extends into the plunger bore 38 and is covered by the neck 33.

Formed inside the cylinder 30 is a receiving space 34 that communicates with the plunger bore 38. Also formed on the outside surface of the cylinder 40 are external threads 40 configured to engage the internal threads 18 formed on the cap bore 15 on the spherical body 12.

The intermediate member 50 is designed to fit into the receiving space 34 formed on the cylinder 30 on the outer housing 22. The intermediate assembly 50 includes a PCB 52 with a 3 way switch circuit 54 formed thereon configured to be activated and deactivated by the up or down movement of a plunger 55. Extending downward from the PCB 52 is a U-shaped bridle 60 designed to hold a stack of three watch batteries 63, 64, and 65. In the embodiment shown herein, the bridle 60 is made electrically conductive material. The bridle 60 is a cage like structure that includes a lower horizontal leg 62 and two downward extending side arms 64, 66. Mounted on the bottom surface of the horizontal leg 62 is a downward extending LED bulb 75. The batteries 68, 69, 70 are vertically stacked inside the space formed between the horizontal leg 62 and the two arms 64, 66 and connected in a series when stacked to produce approximately 4.5 to 5 volts. The upper battery 68 is aligned so that its negative pole makes contact with the electrical contact 58 formed on the bottom of the PCB 52. The positive pole on the lower battery 70 contacts an electrical contact 59 that extends upward through the horizontal leg 62 and connects to an LED bulb 75 that extend downward from the bottom surface of the horizontal leg 62. The bridle 60 is configured in shape and size to hold the stacked batteries 68, 69, 70 in place.

The inner housing 80 is designed to selectively attach to the cylinder 30 and cover the intermediate assembly 50 and to hold the intermediate member 50 in place in the receiving space 34 formed on the outer housing 22. The inner housing 80 includes a lower plate 82 with an upward extending cylindrical body 86. The height of the cylindrical body 86 is sufficient to partially cover the intermediate member 50. Formed coaxially in the lower plate 82 is a bulb bore 84 through which the distal end of a LED bulb 75 extends. Formed on the upper edge of the cylindrical body 86 is a laterally extending tab 88 that engages the L-shaped slot 35 formed on the lower edge of the cylinder 30 on the outer housing 22. During assembly, the outer housing 22 and the inner housing 80 are longitudinally aligned and coaxially rotated so that the tab 88 is longitudinally aligned over the slot 35 thereby enabling the inner housing 80, when forced inward and rotated, to be selectively locked into position on the outer housing 22. Optional serrations 89 may be formed on the outer surface of the outer surface of the lower plate 82 to facilitate rotation of the inner housing 80 on the cylinder 30.

After assembly, the intermediate member 50 is coaxially aligned and protected inside the receiving cavity 34 formed in the outer housing 22, the tip of the plunger 55 partially extends through the plunger bore 38, and the LED bulb 75 extends through the bulb bore 84 and into the spherical body 12.

As stated above, in the preferred embodiment, the PCB 52 includes a three way switch circuit 54 that operates in three modes: OFF; ON-SOLID; or ON-FLASHING. It should be understood that a circuit 54 could be replaced by a two or a four switch circuit.

The length of the cylinder on the outer housing 22, the length of the bridle 60, the thickness of the PCB 52 and the length of the plunger 55 are sufficient so that the top surface of the plunger 55 is transversely aligned under and slightly recessed in the plunger bore 38 thereby protecting the end of the plunger 55 from contact against the surface or external objects when tossing or rolling across a playing surface. The cap assembly 20 is tighten securely into the cap bore 15 which forces the sealing washer 32 against the support surface to create a water tight seal between the spherical body 12 and the cap assembly 20. FIGS. 6-9 are illustrations shown how the batteries 68, 69 and 70 are removed and replaced.

As shown in FIG. 1, eight game balls 10A-G are used to play Bocce and distributed in an outer container 100 and sold as a kit 90 with an instruction sheet 102 and a tape measure 104. There are four pairs 10A and 10B, 10C and 10D, 10E and 10F, 10G and 10H of game Bocce balls in the kit 90 with each pair of balls has a unique color that enables four players to identify his or her balls in the court. Also included in the kit 90 is a small target ball 106 that is identical in structure and functionality of the larger game balls 10. The small target ball 106 is usually a distinct color (i.e. white) from the colors used in the game balls 10.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An illuminated game ball with an improved illuminated cap assembly that enables a user to manually control illumination for daytime and night time use, reduce accidental activation, and allows for easier battery exchange, comprising:

a. a solid, opaque, spherical body with an axially aligned cap bore that partially extends into said spherical body;

b. an illuminated cap assembly configured to be selectively inserted and temporarily locked into said cap bore, said cap assembly includes an outer housing, an intermediate member, and an inner housing, said outer housing includes a top flange plate and a perpendicular aligned, hollow cylinder opened at one end, said top flange plate includes a transversely aligned slot and a coaxially aligned plunger bore, said intermediate member includes a PCB with a perpendicular aligned bridle attached thereto and an upward extending plunger switch, said bridle includes a lower horizontal surface with at least one longitudinally aligned, downward extending LED bulb attached thereto, said inner housing includes a lower flange plate and an upward extending cylindrical side wall that surrounds said intermediate member, said lower flange plate includes an LED bulb bore, said cylindrical side wall on said inner housing being smaller in diameter than said cylindrical side wall on said outer housing thereby enabling inner housing to fit into said outer housing;

c. three stacked batteries located inside said bridle and electrically connected between said PCB and said LED, and d. whereby when said intermediate light assembly is coaxially aligned inside said inner housing and said inner housing is attached to said outer housing, said plunger on said intermediate light assembly is recessed and coaxially aligned with said plunger bore formed on said top flange plate on said outer housing, and said LED bulb extends downward through said bulb hole on said lower flange plate on said inner housing.

2. The game ball, as recited in claim 1, wherein said cap bore formed on said spherical body includes internal threads formed therein and said outer housing includes external threads that are meshed together to enable said illuminated cap assembly to be selectively attached or detached from said cap bore.

3. The game ball, as recited in claim 1, wherein said switch circuit on said PCB operates in three modes: Off, LED ON-STEADY; LED ON-FLASHING.

4. The game ball, as recited in claim 1, further including a sealing washer disposed around said cylinder on said outer housing that provides a watertight seal when said cap assembly is attached to said cap bore on said spherical body.

5. The game ball, as recited in claim 4, further including a closed neck formed on said washer that extends into said plunger bore formed on said outer housing.

6. An illuminated game ball comprising a solid, opaque, spherical body with an axially aligned cap bore that partially extends into said spherical body; and an illuminated cap assembly configured to be selectively inserted and temporarily locked into said cap bore, the improvement comprising:

a. said cap assembly includes an outer housing, an intermediate member, and an inner housing, said outer housing includes a top flange plate and a perpendicular aligned, hollow cylinder opened at one end, said top flange plate includes a transversely aligned slot and a coaxially aligned plunger bore, said intermediate member includes a PCB with a perpendicular aligned bridle attached thereto and an upward extending plunger switch, said bridle includes a lower horizontal surface with at least one longitudinally aligned, downward extending LED bulb attached thereto, said inner housing includes a lower flange plate and an upward extending cylindrical side wall that surrounds said intermediate member, said lower flange plate includes an LED bulb bore, said cylindrical side wall on said inner housing being smaller in diameter than said cylindrical side wall on said outer housing thereby enabling inner housing to fit into said outer housing; and b. three stacked batteries located inside said bridle and electrically connected between said PCB and said LED.

7. An illuminated game ball kit, comprising:

four pairs of illuminated spherical balls, an outer container 100, a tape measure, a target ball, and a game instruction sheet;

each said spherical ball includes a solid, opaque, spherical body with an axially aligned cap bore that partially extends into said spherical body, and an illuminated cap assembly configured to be selectively inserted and temporarily locked into said cap bore, said cap assembly includes an outer housing, an intermediate member, and an inner housing, said outer housing includes a top flange plate and a perpendicular aligned, hollow cylinder opened at one end, said top flange plate includes a transversely aligned slot and a coaxially aligned plunger bore, said intermediate member includes a PCB with a perpendicular aligned bridle attached thereto and an upward extending plunger switch, said bridle includes a lower horizontal surface with at least one longitudinally aligned, downward extending LED bulb attached thereto, said inner housing includes a lower flange plate and an upward extending cylindrical side wall that surrounds said intermediate member, said lower flange plate includes an LED bulb bore, said cylindrical side wall on said inner housing being smaller in diameter than said cylindrical side wall on said outer housing thereby enabling inner housing to fit into said outer housing, each said spherical ball also includes three stacked batteries located inside said bridle and electrically connected between said PCB and said LED.

* * * * *